US005988387A

United States Patent [19]

Staal et al.

[11] Patent Number: 5,988,387

[45] Date of Patent: Nov. 23, 1999

[54] SUSPENSION PACKAGE

[75] Inventors: Dean Staal, Chicago; William Bartlett, South Beloit; Priscilla Keach, Chicago, all of Ill.

[73] Assignee: ADE, Inc., Chicago, Ill.

[21] Appl. No.: 09/108,358

[22] Filed: Jul. 1, 1998

[51] Int. Cl.[6] ..... B65D 81/02

[52] U.S. Cl. ..... 206/583; 206/1.5; 206/454

[58] Field of Search ..... 206/583, 521, 206/590, 594, 585, 1.5, 508, 509, 454, 455; 220/833, 836, 840, 849, 4.22, 520

[56] References Cited

U.S. PATENT DOCUMENTS

| | | | |
|---|---|---|---|
| 2,681,142 | 6/1954 | Cohen | 206/583 |
| 2,732,581 | 1/1956 | Heck | 220/840 |
| 3,343,662 | 9/1967 | Bendoff . | |
| 3,489,265 | 1/1970 | Puente | 206/583 |
| 4,267,684 | 5/1981 | Ambrose | 53/472 |
| 4,491,225 | 1/1985 | Baillod . | |
| 4,606,460 | 8/1986 | Luray . | |
| 4,615,464 | 10/1986 | Byrns | 220/833 |
| 4,697,701 | 10/1987 | Ying . | |
| 4,714,228 | 12/1987 | Blaushild . | |
| 4,903,827 | 2/1990 | Phelps et al. | 206/583 |
| 5,009,222 | 4/1991 | Her | 128/36 |
| 5,167,351 | 12/1992 | Prout et al. | 220/338 |
| 5,183,159 | 2/1993 | Hojnacki et al. . | |
| 5,218,510 | 6/1993 | Bradford | 361/220 |
| 5,311,643 | 5/1994 | Marquardt et al. | 16/267 |
| 5,405,000 | 4/1995 | Hagedon et al. | 206/216 |
| 5,769,235 | 6/1998 | Keach et al. . | |
| 5,857,573 | 1/1999 | Pakeriasamy | 206/723 |

*Primary Examiner*—Paul T. Sewell
*Assistant Examiner*—Shian T. Lam
*Attorney, Agent, or Firm*—Brinks Hofer Gilson & Lione

[57] ABSTRACT

A suspension package includes upper and lower covers. The covers include oval exterior walls that define oval product-receiving wells. Oval mounting rings are mounted to the covers to support resilient films over the wells. The covers define generally rectangular inner exterior walls that support hinges along a hinge axis. By combining rectangular covers adjacent to hinges with oval covers spaced from the hinges, material costs are reduced and fabrication is simplified.

10 Claims, 6 Drawing Sheets

SUSPENSION PACKAGE

BACKGROUND

This invention relates to suspension packages of the type that suspend an article within upper and lower covers, held in place by resilient suspension films.

Suspension packages of the general type described above are known to the art, as shown for example in Hojnacki, U.S. Pat. No. 5,183,159, Baillod, U.S. Pat. No. 4,491,225 (assigned to the assignee of the present invention) and U.S. Pat. No. 5,769,235 (assigned to the assignee of the present invention).

The suspension package disclosed in U.S. Pat. No. 5,769,235 includes upper and lower generally rectangular covers. The covers are hinged together, and each supports an oval mounting ring. The mounting ring in turn supports the suspension film. In this suspension package, the mounting ring is provided with mounting legs that are latched in place in recesses of the covers. This arrangement can provide the important advantage that the suspension film is automatically tensioned when the mounting ring is secured in place in the cover. However, molding of the covers and the mounting ring is complicated by the need to form latching surfaces on the mounting ring and the covers. Also, the use of an oval mounting ring inside a rectangular cover increases the need for interior walls and thereby further increases the cost of the covers.

The present invention is directed to an improved suspension package that is well adapted to low cost fabrication techniques, and that reduces or minimizes material costs.

SUMMARY

The scope of the present invention is defined by the following claims, and nothing in this section should be taken as limitation on those claims. By way of introduction, the preferred embodiment described below provides covers that combine the advantages of a generally rectangular peripheral portion (well suited for the mounting of spaced hinges along a hinge axis) with an oval well and an oval exterior wall defining the well. These covers combine the advantages of generally rectangular peripheral portions near the hinges with generally oval intermediate portions adjacent the well, and material costs are thereby reduced. In the embodiment described below, the mounting rings are held in place without latches by means of friction fits between tapered mounting legs and complementarily tapered receiving sockets. By eliminating the need for latching surfaces, molding operations required to form the covers are simplified.

DETAILED DESCRIPTION OF THE PRESENTLY PREFERRED EMBODIMENTS

Figure 1:
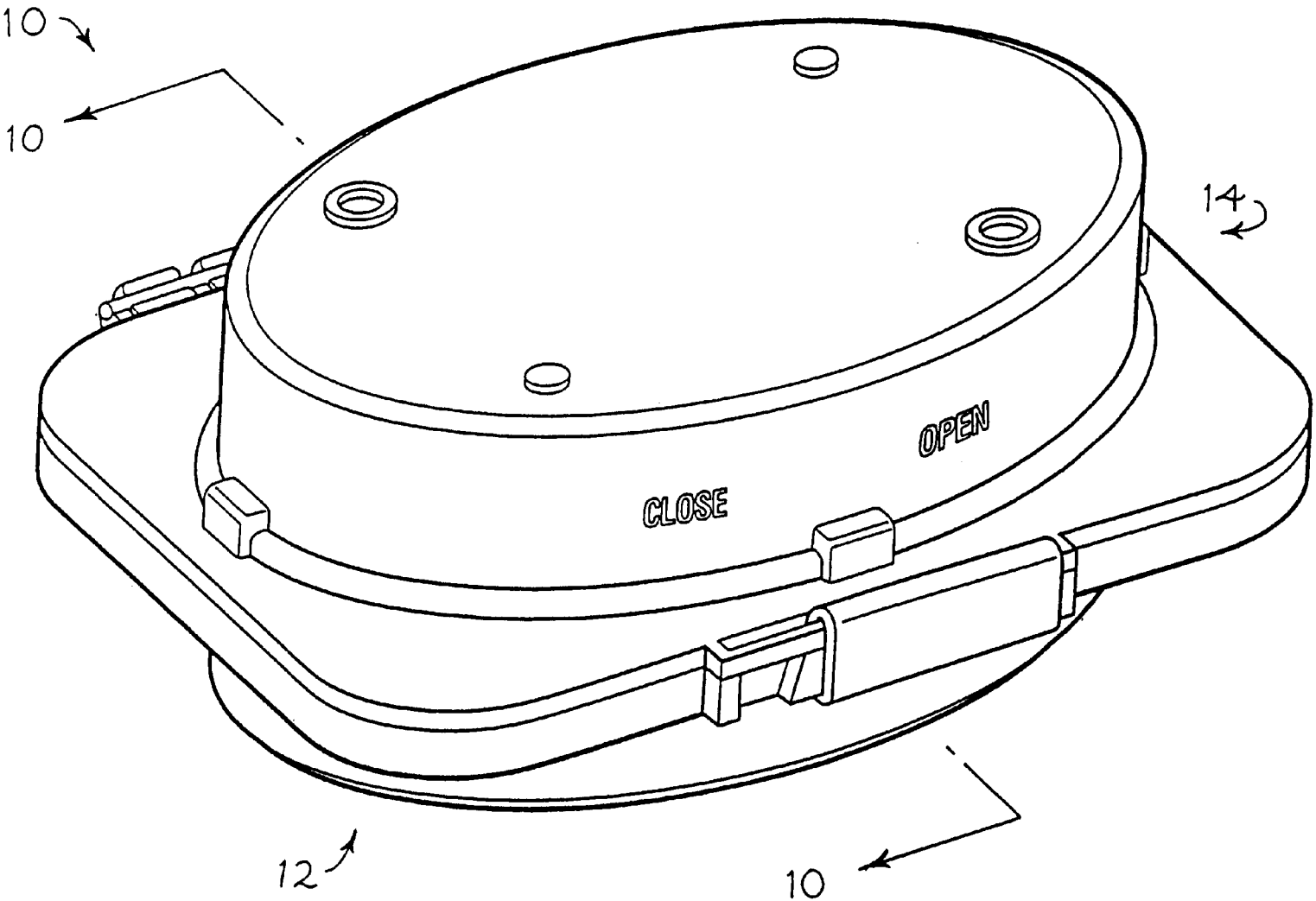
FIG. 1 is a perspective view of a suspension package that incorporates a presently preferred embodiment of this invention.

Turning now to the drawings, FIG. 1 shows an overall view of a suspension package 10 that incorporates a presently preferred embodiment of this invention. The following sections will first describe the lower cover 12 and the upper cover 14 in detail before discussing the assembly.

Figure 2:
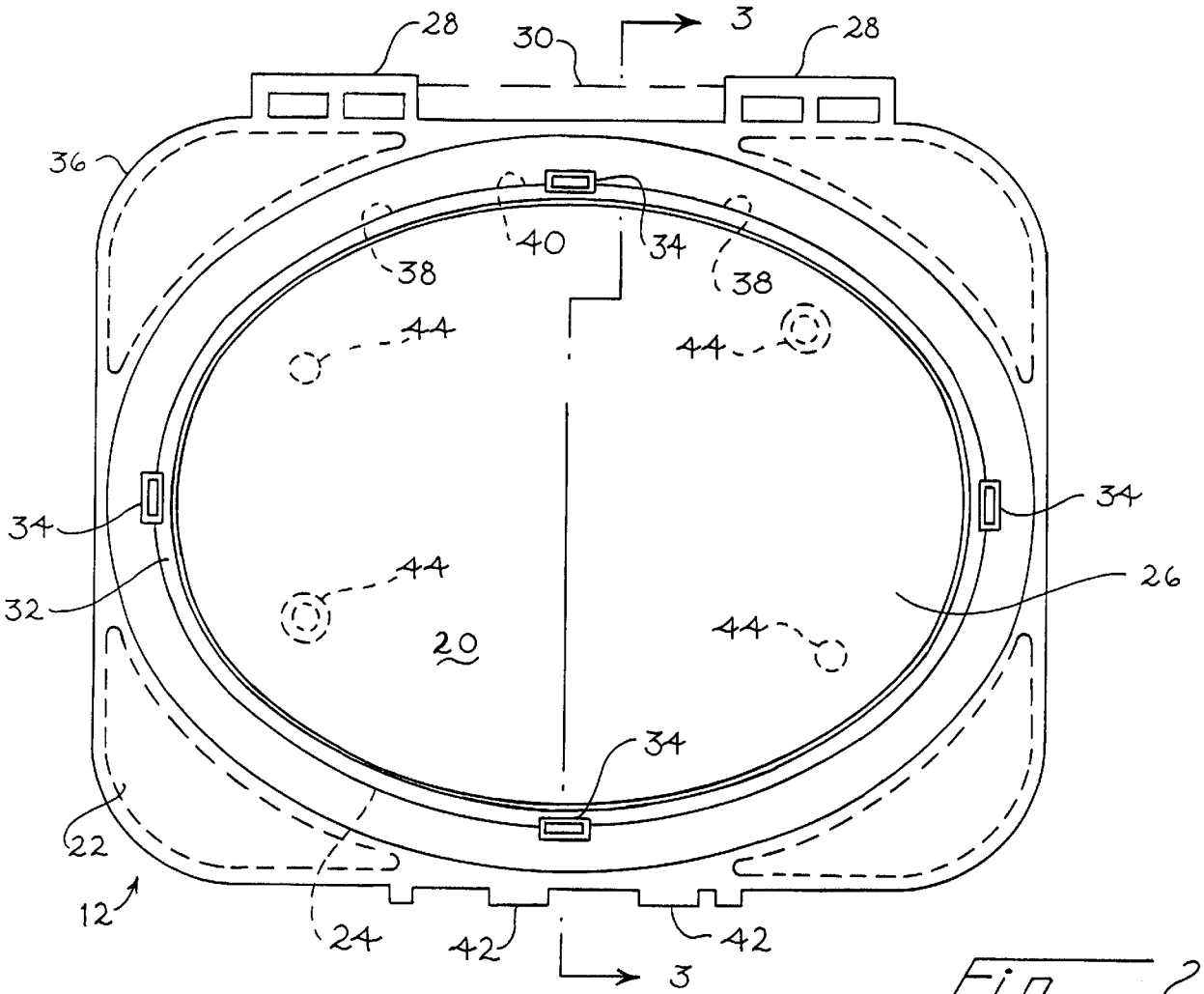
FIG. 2 is a plan view of the lower cover of the suspension package of FIG. 1.
Figure 3:
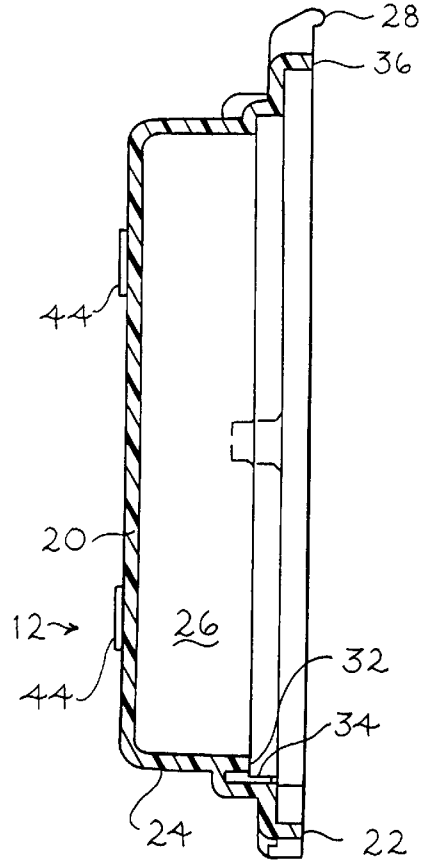
FIG. 3 is a cross-sectional view taken along line 3—3 of FIG. 2.

As best shown in FIGS. 2 and 3, the lower cover 12 is a rigid element that is preferably molded in one piece. The lower cover 12 includes an outer exterior wall 20 that is oval in shape in this embodiment, an inner exterior wall 22, and an intermediate exterior wall 24 that interconnects the walls 20, 22. In this embodiment the intermediate exterior wall 24 is also oval in shape, and the intermediate wall 24 cooperates with the outer wall 20 to form an oval product-receiving well 26.

The inner exterior wall 22 supports two spaced hinge parts 28. In this embodiment, the hinge parts 28 define hinge pins, as shown in FIG. 2, and the hinge pins define a hinge axis 30. Note that all of the hinge pins included in the hinge parts 28 are colinear.

As best shown in FIG. 2, the lower cover 12 includes an oval ledge 32, and four closed end, tapered sockets 34 are formed in the lower cover 12 adjacent the ledge 32. The inner exterior wall 22 defines a peripheral portion 36 that in this embodiment is generally rectangular. As used herein the term "rectangular" is intended broadly to encompass rectangular (including square) shapes, with or without rounded corners.

Because of the generally rectangular peripheral portion 36 and the oval intermediate exterior wall 24, the spacing between the intermediate exterior wall 24 and the hinge axis 30 varies continuously. In particular, the intermediate exterior wall 24 includes first portions 38 aligned with the hinge parts 28 and a second portion 40 intermediate the first portions 38. Note that the first portions 38 are positioned farther from the hinge axis 30 than is the second portion 40. The use of an oval intermediate exterior wall 24 and an oval ledge 32 allows the use of an oval mounting ring for the suspension film, as described below. Such an oval shape for the mounting ring is believed to provide advantages in terms of improved support for the suspension film.

Because the mounting rings are oval, the support for the films is more nearly constant. This provides more nearly constant support for the article being packaged. As used herein the term "oval" is intended broadly to encompass shapes that are elongated as shown in the drawings, or that closely approximate a circle.

As shown in FIG. 2, the lower cover 12 also includes locking tabs 42 on the inner exterior wall 22 opposite the hinge parts 28, and stacking lugs 44 on the outer exterior wall 20.

Figure 4:
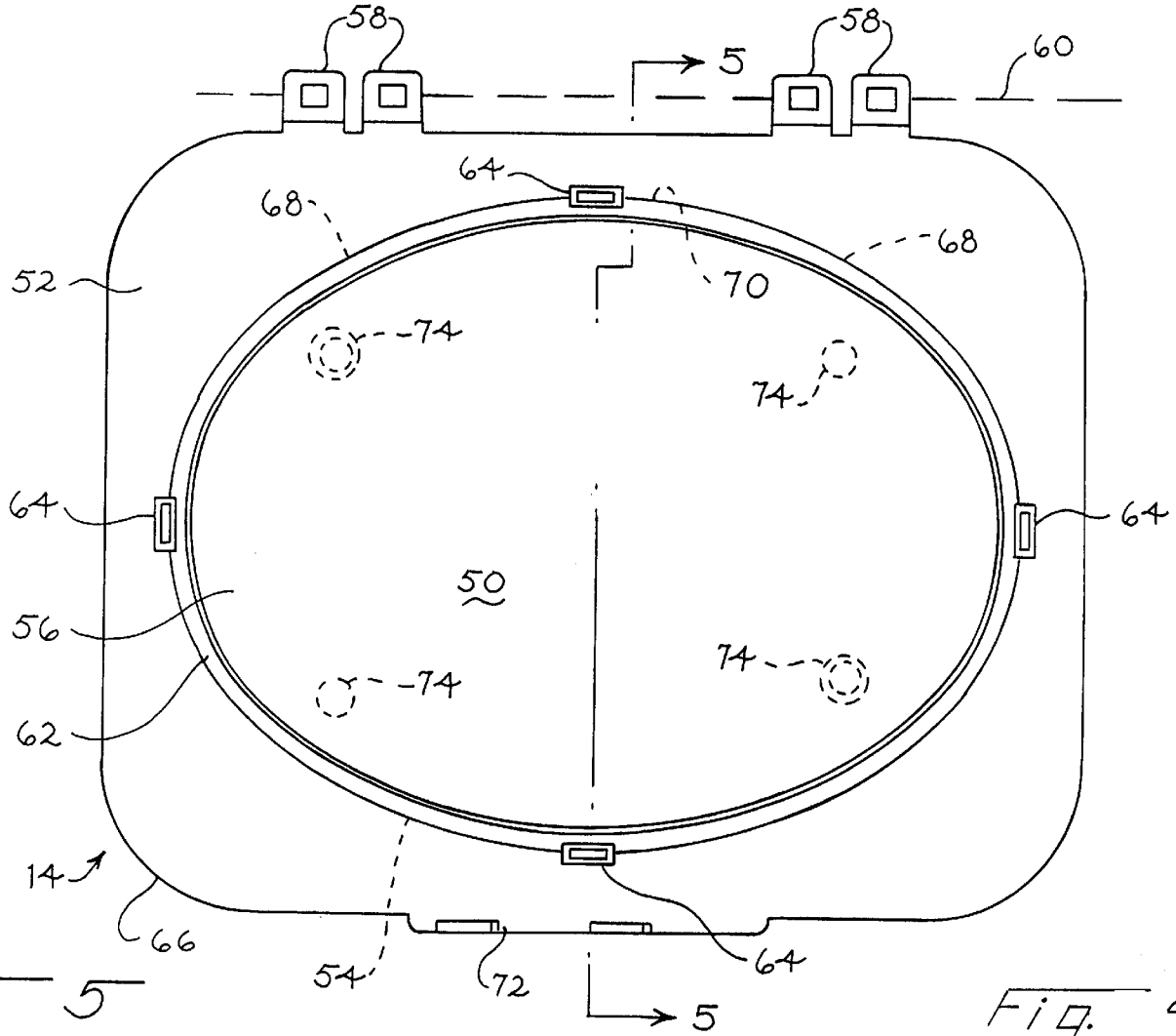
FIG. 4 is a plan view of the upper cover of the suspension package of FIG. 1.
Figure 5:
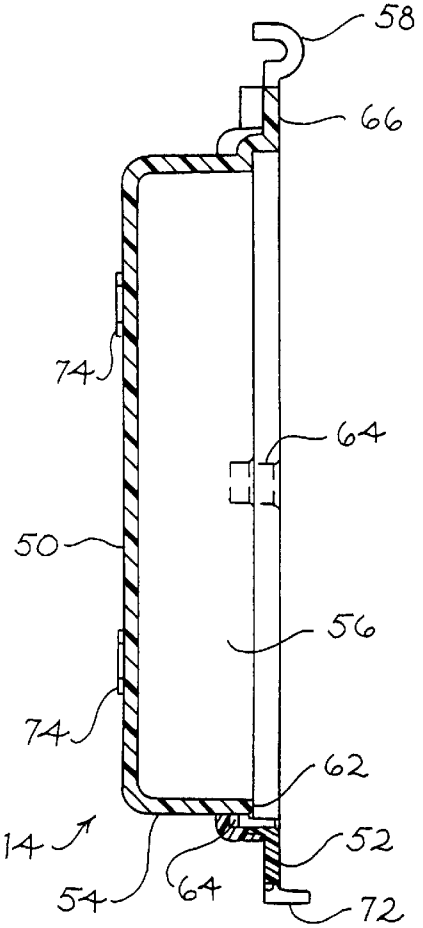
FIG. 5 is a cross-sectional view taken along line 5—5 of FIG. 4.

As shown in FIGS. 4 and 5, the upper cover 14 is in many ways similar to the lower cover 12 described above. In particular, the upper cover 14 includes an outer exterior wall 50, an inner exterior wall 52, and an intermediate exterior wall 54. The intermediate exterior wall 54 defines an oval product-receiving well 56, and the inner exterior wall 52 supports hinge parts 58 aligned along the hinge axis 60. In this case the hinge parts 58 form hooks sized to receive the pins of the hinge parts 28.

The inner exterior wall 52 includes a generally rectangular peripheral portion 66, and the intermediate exterior wall 54 defines first portions 68 aligned with the hinge parts 58 and a second portion 70 intermediate the first portions 68. As before, the first portions 68 are farther from the hinge axis 60 than is the second portion 70.

An oval ledge 62 surrounds the oval well 56, and four tapered, closed-end sockets 64 are evenly spaced around the well 56. The upper cover 14 also defines locking tabs 72 and stacking lugs 74.

Another difference between the lower and upper covers 12, 14 is shown in FIGS. 3 and 5. Note that the peripheral portion 36 of the lower cover 12 extends above the ledge 32 to a greater extent than the peripheral portion 66 of the upper cover 14 extends above the ledge 62.

Figure 6:
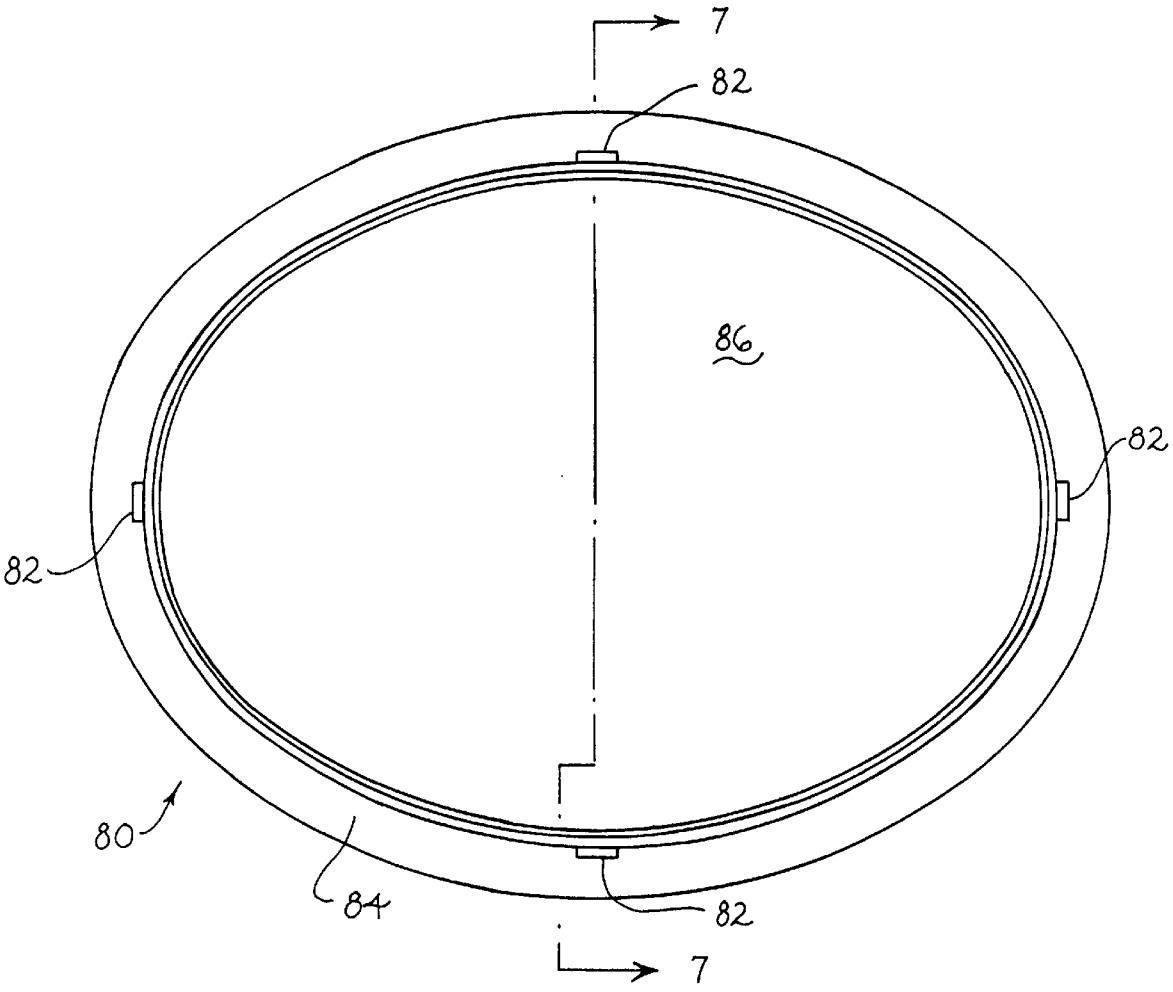
FIG. 6 is a plan view of one of the retainer rings of the embodiment of FIG. 1.
Figure 7:
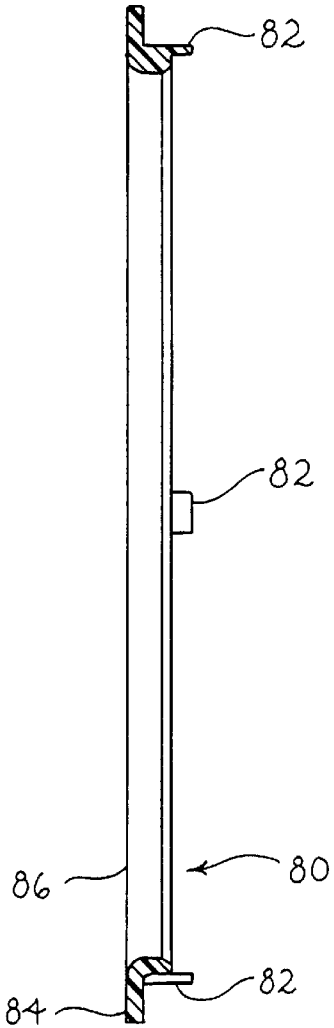
FIG. 7 is a cross-sectional view taken along line 7—7 of FIG. 6.

As shown in FIGS. 6 and 7, mounting rings 80 are provided for suspension films 86. Each of the mounting rings 80 includes four tapered mounting legs 82, and the mounting legs 82 are free of latching surfaces. The mounting legs 82 are configured to fit within the respective sockets 34, 64 and to be held in place by a friction fit. Each mounting ring 80 defines a film mounting surface 84 that supports the respective film 86.

Figure 8:
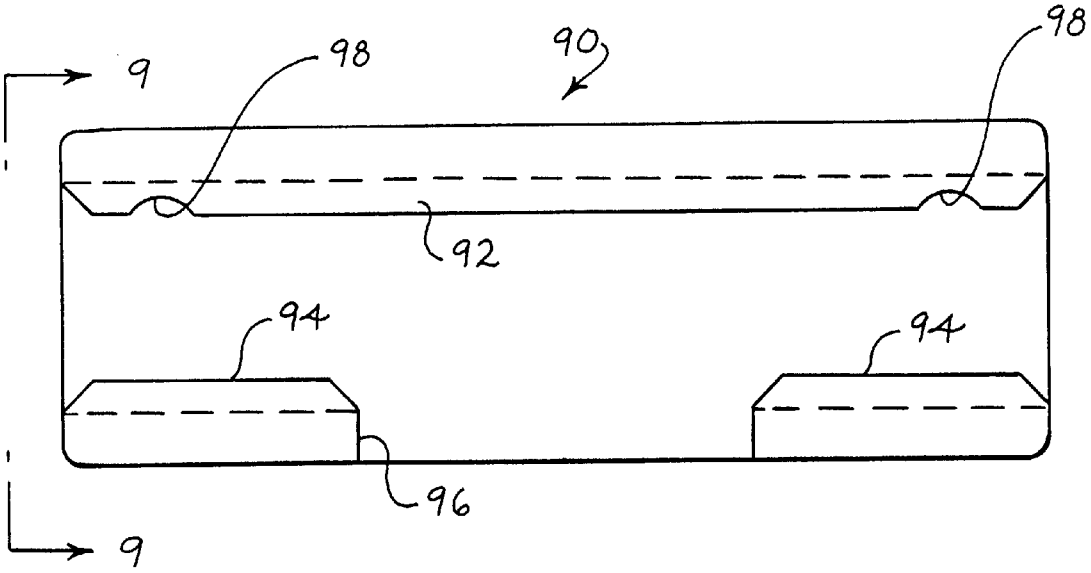
FIG. 8 is a rear view of a closure included in the embodiment of FIG. 1.
Figure 9:
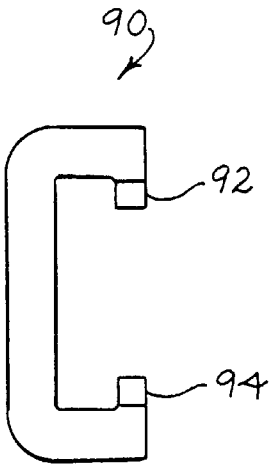
FIG. 9 is an end view taken along line 9—9 of FIG. 8.

As shown in FIGS. 8 and 9, the suspension package 10 includes a slide closure 90 that is generally C-shaped in cross section and includes an upper flange 92 and a lower flange 94. The lower flange 94 defines a window 96, and the upper flange 92 defines detent recesses 98.

Figure 10:
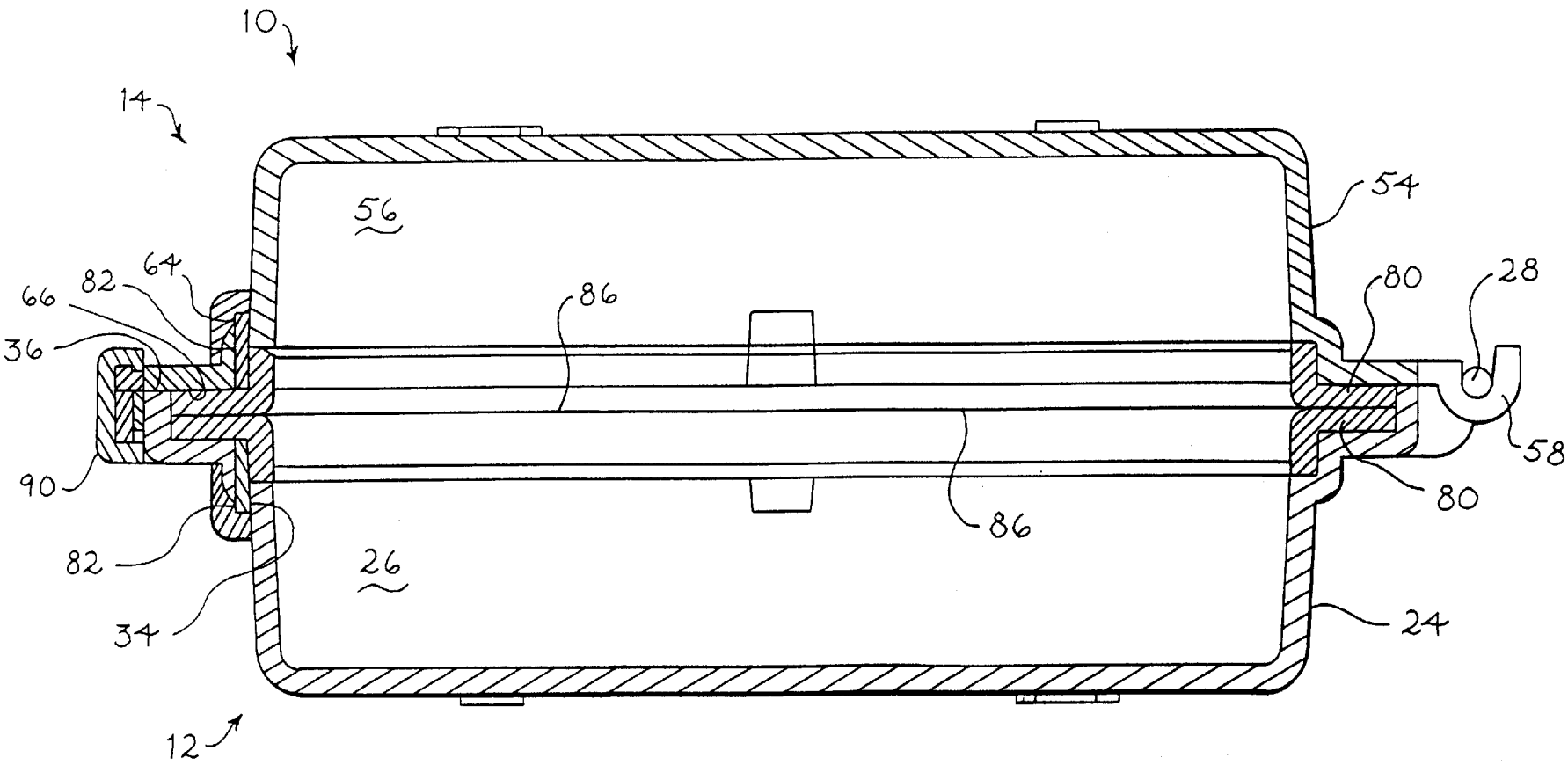
FIG. 10 is a cross-sectional view taken along line 10—10 of FIG. 1.

FIG. 10 shows a cross sectional view of the assembled suspension package 10. Assembly is accomplished by first mounting the films 86 to the mounting rings 80, as for example with sonic welding techniques. Then each of the mounting rings 80 is mounted to the respective cover 12, 14 by pushing the mounting legs 82 into the sockets 34, 64. The mounting legs 82 are dimensioned to hold the mounting rings 80 in place with a friction fit.

Then the slide closure 90 is installed on the upper cover 14 and the hinge parts 28, 58 are snapped together. The hinge parts 28, 58 cooperate to form hinges that allow the lower and upper covers 12,14 to pivot between open and closed positions. In the closed position shown in FIG. 10, the films 86 are held in closely spaced, parallel relationship with a packaged article (not shown) clamped in place between the films and disposed in the wells 26, 56. Note that when the covers 12, 14 are in the closed position of FIG. 10, the film mounting surfaces of the mounting rings 80 are held in face-to-face contact with the films 86 clamped therebetween. When the slide closure 90 is positioned in one slide position, the locking tabs are captured in the closure 90 and the suspension package 10 is held in the closed position. By sliding the closure 90 to align the window with the locking tabs, the upper cover 14 is freed to pivot to the open position.

As shown in FIG. 10, the film 86 associated with the lower cover 12 is recessed with respect to the peripheral portion 36, while the film 86 associated with the upper cover 14 protrudes beyond the peripheral portion 66. This arrangement provides a recessed pocket to receive articles on the film 86 in the lower cover 12, thereby reducing any tendency of such articles to roll or otherwise move off of the film 86 before the suspension package 10 is closed.

The suspension package 10 provides a number of important advantages. Since the peripheral portions 36, 66 are generally rectangular, the hinge parts 28, 58 can be spaced relatively far apart to provide a stable hinge and the slide closure 90 is provided with a straight side on which to operate. Because the intermediate exterior walls 24, 54 are oval in shape (matching the shape of the mounting rings 80), a single intermediate exterior wall can both form an outer surface of the covers 12, 14 and define the lateral extent of the oval well 26, 56. This reduces the amount of material required to form the covers 12, 14 as opposed to certain prior art designs which included interior walls in addition to the exterior walls.

Furthermore, since the mounting rings 80 are held in place in the covers 12,14 with a friction fit rather than a latch mechanism, the sockets 34, 64 can be simply molded in a conventional molding operation in which the mold parts move in only a single direction as the mold is open or closed. This further reduces manufacturing cost.

Simply by way of example, the following details of construction are provided to clarify the best mode of the present invention. In this example the overall dimensions of the suspension package 10 are approximately 3.9 inches in width, 4.8 inches in length, and 1.7 inches in height. Each of the wells 26, 56 is 0.75 inches in depth. The mounting rings 80 can be formed of a material such as PUR (e.g., Dow 302EZ PUR), and have a wall thickness of 0.70 inches. The lower and upper covers 12, 14 can be formed of a material such as PCTG (e.g., Eastman PCTG), and can also use a wall thickness of 0.70 inches. The slide closure 19 can also be formed of a material such as polypropylene (e.g., Exxon 9074 PP), and the suspension film 86 can be formed of a material such as 2–4 mil polyurethane.

In the suspension package 10 the film 86 is preferably tensioned on the mounting rings 80 before the mounting rings 80 are installed in place on the covers 12,14. This can be done by generally stretching the films 86 with a holding fixture as the film 86 is secured in place to the mounting rings 80 in a sonic welding operation. Note that the outer periphery of the rings 80 defines a smooth oval shape, which facilitates trimming of excess film after the film has been secured to the rings 80. For example, the holding fixture for the film may hold enough film for one to six or more rings, which all can be secured to the film in a single bonding operation.

Of course, many changes and modifications can be made to the preferred embodiment described above. For example, the various walls have been illustrated as plates, and they can be formed with or without ribs, as curved or flat sections, with or without interior walls. If desired the film may be mounted directly to the cover rather than to a mounting ring that is in turn mounted to the cover, and dimensions, proportions and other geometrical considerations can all be modified as appropriate for the particular application. For example, the peripheral portion 36 may be square and the intermediate exterior wall 24 may be circular in cross section.

The foregoing detailed description has described only a few of the many forms that the present invention can take. For this reason it is intended that this description be regarded as illustrative rather than limiting. It is only the following claims, including all equivalents, that are intended to define the scope of this invention.

We claim:

1. A suspension package comprising:

first and second covers, each cover comprising:

a peripheral exterior wall;

a central exterior wall;

an intermediate exterior wall interconnecting the peripheral and central exterior wall and extending around a well; and at least two hinge parts disposed on the central exterior wall along a hinge axis;

first and second mounting rings secured to the first and second covers, respectively:

first and second suspension films secured to the first and second mounting rings, respectively, to extend over the respective wells near the respective central walls;

said hinge parts coupled together to pivotably mount the first cover to the second cover;

wherein each of the mounting rings comprises a respective film-mounting surface to which the respective films are secured, and wherein the covers are configured to hold the two film-mounting surfaces together with the films clamped therebetween:

wherein one of the films is recessed with respect to a peripheral portion the respective central exterior wall and wherein the other of the films protrudes beyond the peripheral portion of the respective central exterior wall.

2. The invention of claim 1 wherein each intermediate exterior wall is oval in shape.

3. The invention of claim 2 wherein the well is oval in shape.

4. The invention of claim 3 wherein the central exterior walls define a generally rectangular peripheral portion.

5. The invention of claim 1 wherein each intermediate exterior wall is oval in shape, and wherein each mounting ring is oval in shape.

6. The invention of claim 1 wherein each said intermediate exterior wall is curved such that first portions of each intermediate exterior wall aligned with the hinge parts are spaced farther from the hinge axes than are second portions of each intermediate exterior wall disposed between the first portions.

7. The invention of claim 6 wherein each intermediate exterior wall is curved, and wherein each peripheral exterior wall comprises a substantially rectilinear peripheral portion that supports the respective hinge parts.

8. The invention of claim 6 wherein the at least two hinge parts for each cover comprise hinge parts on both sides of a central axis of the respective cover.

9. The invention of claim 1 wherein each said intermediate exterior wall is curved such that first portions of each intermediate exterior wall aligned with the hinge parts are spaced farther from the hinge axes than are second portions of each intermediate exterior wall disposed between the first portions.

10. The invention of claim 9 wherein the mounting legs are tapered.

* * * * *

UNITED STATES PATENT AND TRADEMARK OFFICE

CERTIFICATE OF CORRECTION

PATENT NO. : 5,988,387
DATED : November 23, 1999
INVENTOR(S) : Dean Staal et al.

It is certified that error appears in the above-identified patent and that said Letters Patent is hereby corrected as shown below:

Claim 2,
Line 1, after "1" insert -- or 7 --.

Claim 5,
Line 1, after "1" insert -- or 7 --.

Claim 6,
Line 1, after "1" insert -- or 7 --.

Claim 9,
Delete entire claim and substitute

-- 9. A suspension package comprising:
first and second covers, each cover comprising:
a peripheral exterior wall;
a central exterior wall;
an intermediate exterior wall interconnecting the peripheral and central exterior wall and extending around a well; and
at least two hinge parts disposed on the central exterior wall along a hinge axis;
first and second mounting rings secured to the first and second covers, respectively;
first and second suspension films secured to the first and second mounting rings, respectively, to extend over the respective wells near the respective central walls;
said hinge parts coupled together to pivotably mount the first cover to the second cover;

UNITED STATES PATENT AND TRADEMARK OFFICE

CERTIFICATE OF CORRECTION

PATENT NO. : 5,988,387
DATED : November 23, 1999
INVENTOR(S) : Dean Staal et al.

It is certified that error appears in the above-identified patent and that said Letters Patent is hereby corrected as shown below:

wherein each mounting ring comprises a plurality of mounting legs, wherein each of the covers comprises a plurality of closed-end sockets configured to receive respective one of the mounting legs, and wherein the mounting legs are received in the closed-end sockets in a friction fit to secure the mounting rings to the respective covers. -- in its place.

Signed and Sealed this

Twenty-sixth Day of February, 2002

*Attest:*

*Attesting Officer*

JAMES E. ROGAN
*Director of the United States Patent and Trademark Office*